US005220122A

United States Patent [19]

Shibukawa

[11] Patent Number: 5,220,122

[45] Date of Patent: Jun. 15, 1993

[54] AUTOMATIC ACCOMPANIMENT DEVICE WITH CHORD NOTE ADJUSTMENT

[75] Inventor: Takeo Shibukawa, Hamamatsu, Japan

[73] Assignee: Yamaha Corporation, Hamamatsu, Japan

[21] Appl. No.: 842,905

[22] Filed: Feb. 27, 1992

[30] Foreign Application Priority Data

Mar. 1, 1991 [JP] Japan ..... 3-36127

[51] Int. Cl.[5] ..... G10H 1/38

[52] U.S. Cl. ..... 84/669; 84/DIG. 22

[58] Field of Search ..... 84/609-614, 84/634-638, 649-652, 666-669, 712-717, DIG. 12, DIG. 22

[56] References Cited

U.S. PATENT DOCUMENTS 4,508,002 4/1985 Hall et al. ..... 84/DIG. 22

5,056,401 10/1991 Yamaguchi et al. ..... 84/635

FOREIGN PATENT DOCUMENTS 1179091 7/1989 Japan .

*Primary Examiner*—Stanley J. Witkowski

*Attorney, Agent, or Firm*—Spensley Horn Jubas & Lubitz

[57] ABSTRACT

The automatic accompaniment device is constructed such as to convert tone data of a preset accompaniment pattern according to inputted or detected chords so as to generate matched accompaniment sounds. The tonality of performed music is detected by comparison between constituent notes of detected 7th chord or 7sus4 chord and those of a preceding detected chord, based on occurrence of note coincidence therebetween. A particular note name is determined for adjustment based on the detected tonality. The device designates a key code of chord constituent note corresponding to the determined note name so as to adjust the key code, thereby performing automatic performance in conformity with the tonality in natural manner.

7 Claims, 13 Drawing Sheets

| TR | track \ CLK | 0 | 1 | 2 ---- 15 |
|---|---|---|---|---|
| 0 | CHORD1 | 0H | FH | FH ---- FH |
| 1 | CHORD2 | 4H | FH | FH ---- FH |
| 2 | CHORD3 | 7H | FH | FH ---- FH |
| 3 | BASS | 0H | FH | FH ---- 0H |
| 4 | RHYTHM1 | 0H | FH | 0H ---- FH |
| 5 | RHYTHM2 | 1H | 1H | 1H ---- 1H |

FIG. 4

CHDPT (i) (i=CTP)

| CTP | bit / Note name | 0 | 1 | 2 | 3 | 4 | 5 | 6 | 7 | 8 | 9 | 10 | 11 |
|---|---|---|---|---|---|---|---|---|---|---|---|---|---|
| | | C | C# | D | D# | E | F | F# | G | G# | A | A# | B |
| 0 | M | 1 | 0 | 0 | 0 | 1 | 0 | 0 | 1 | 0 | 0 | 0 | 0 |
| 1 | m | 1 | 0 | 0 | 1 | 0 | 0 | 0 | 1 | 0 | 0 | 0 | 0 |
| 2 | 7th | 1 | 0 | 0 | 0 | 1 | 0 | 0 | 1 | 0 | 0 | 1 | 0 |
| 3 | m7th | 1 | 0 | 0 | 1 | 0 | 0 | 0 | 1 | 0 | 0 | 1 | 0 |
| 4 | 7th | 1 | 0 | 0 | 0 | 1 | 0 | 0 | 1 | 0 | 0 | 1 | 0 |
| ⋮ | sus4 | | | | | | | | | | | | |
| ⋮ | ⋮ | | | | | | | | | | | | |

→

FIG. 5

| | |
|---|---|
| m | Lowering 3° tone by one semitone interval |
| 7th | Lowering 7° tone by one semitone interval |
| m7 | Lowering 3° and 7° tones by one semitone interval |
| $m7^{-5}$ | Lowering 3°, 5° and 7° tones by one semitone interval |
| 7sus4 | Raising 3° tone by one semitone interval and lowering 7° tone by one semitone interval |

AUTOMATIC ACCOMPANIMENT DEVICE WITH CHORD NOTE ADJUSTMENT

BACKGROUND OF THE INVENTION

The present invention relates to an automatic accompaniment device for performing automatic accompaniment to generate chord tones and bass tones based on chord designation inputted from a keyboard and an accompaniment pattern stored in a memory.

Conventionally, there is an automatic accompaniment device which memorizes an accompaniment pattern. The device modifies the accompaniment pattern based on performer-played chords, and generates musical tones in accordance with the modified accompaniment pattern to thereby perform an automatic accompaniment. The device can memorize a plurality of accompaniment patterns for different styles or kinds of music compositions such as Rock, Country and so on. The accompaniment pattern is a prescribed sequence of tone generation timing for each constituent note of the chord. The accompaniment pattern contains tone pitch data representing the intervals, from the root, of the constituent notes of a standard chord, for example, C major chord. The tone pitch data addressed by a tempo clock which determines divided time slots within a given measure. When performing an automatic accompaniment the constituent notes of the standard chord is converted into constituent notes of a chord to be performed according to the type and the root note of the chord to be performed. For instance, if accompaniment pattern is recorded or programmed in terms of standard chord C, when chord Dm is detected in the musical instrument, each of constituent note data read from the stored accompaniment pattern is raised uniformly by 2 degrees and further the raised third note is lowered by one semitone interval so as to generate tuned tones. Such method is disclosed in Japanese Patent Application Laid-Open No. 179091/1989. As mentioned above, the accompaniment pattern is built in terms of a particular standard chord, and the conversion of the prescribed pattern is carried out to determine constituent notes of a different chord to be generated. By such a manner, there is no need to prepare different but similar accompaniment patterns for every tonality, thereby advantageously saving a capacity of memory in the device.

However, in the above noted conventional device, the accompaniment pattern represented by interval is uniformly changed solely based on the type of an individually detected chord which is to be reproduced, hence there may be occasionally generated an inconsistent tone of a pitch name which does not match with the tonality of a given music composition.

Referring to FIG. 14, a description is given below for adjustment for an inconsistent pitch tone in case that the accompaniment pattern is with respect to chord C and the tonality of music is tuned to C major key. FIG. 14 is a diagram schematically showing scales in different tonalities of C major, F major, G major and C minor. The accompaniment pattern of chord C is recorded in terms of degrees corresponding to syllable names (Do, Re, Mi, Fa, So, La, Ti) of C major scale. If chord F is detected, the original accompaniment pattern of chord C is converted into that of chord F, such that its, constituent notes are shifted by intervals or actoves corresponding of syllable names of F major scale (Fa, So, La ---). However, F major scale contains a syllable name of Tib (sus4), whereas C major scale does not contain the syllable name of Tib so that generally the note of this syllable name does not match with a given music composition tuned to C major scale, thereby generating an inconsistent tone. Further descriptions will be given later for the G major scale and C minor scale.

SUMMARY OF THE INVENTION

An object of the present invention is to provide an automatic accompaniment device which can perform an automatic accompaniment in conformity with a given tonality in a natural manner.

According to the invention, the automatic accompaniment device is comprised of chord detecting means for detecting a chord according to inputted tone pitch or note information representing note names, and converting means for converting accompaniment tone data representing notes arranged as a predetermined accompaniment pattern into other accompaniment tone data representing notes corresponding to the detected chord. The device is further comprised of tonality detecting means for detecting a tonality of a music composition represented by the inputted note information, note name determining means for determining a note name unbecoming to the detected tonality, note designating means for designating a note corresponding to the determined note name in the converted accompaniment pattern, and changing means for changing the designated note into another note which is becoming to the detected tonality so that the converted accompaniment pattern can be becoming to the detected tonality.

In the inventive automatic accompaniment device, the tonality detecting means judges or recognizes tonality of the chordal arrangement or chord framework based on the inputted note information to provide the tonality information to the note name determining means. Then, the note name determining means determines a particular note name to be changed or adjusted, based on the recognized tonality. Further, the note designating means selects a specific note corresponding to the determined note name in the converted accompaniment pattern. The selected note is adjusted or changed appropriately so as to produce the accompaniment sounds in conformity with the given tonality of music.

BRIEF DESCRIPTION OF THE DRAWINGS

FIG. 4 is a table diagram showing chord patterns used in the inventive device;

FIG. 5 is a diagram showing an example of a chord conversion table used in the inventive device;

DETAILED DESCRIPTION OF THE INVENTION

Figure 1:
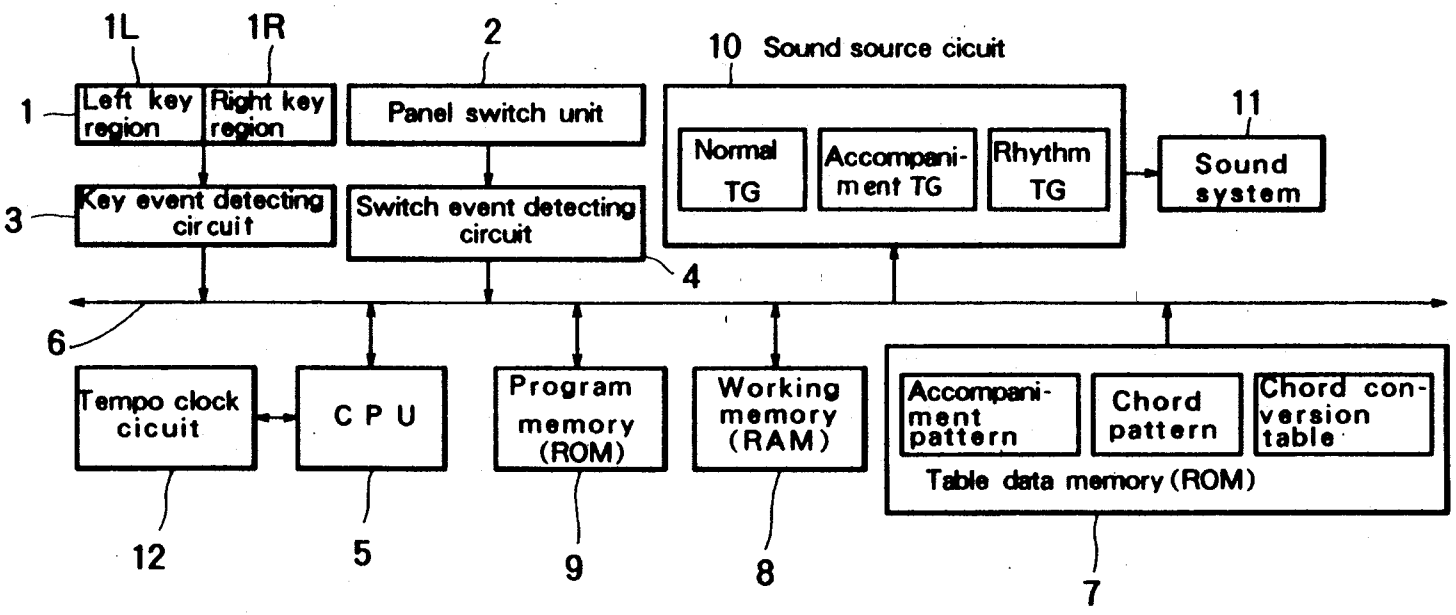
FIG. 1 is a block diagram of an electronic musical instrument provided with an embodiment of an automatic accompaniment device according to the invention.

Referring to FIG. 1 which shows a block diagram of an electronic musical instrument of the keyboard type provided with a preferred embodiment of the inventive automatic accompaniment device, a keyboard 1 and a panel switch unit 2 are provided to carry out a manual melody performance and an automatic accompaniment performance. A key event detecting circuit 3 is connected to detect a key event occurring on the keyboard 1 to produce a key code corresponding to a depressed or released key on the event as well as to produce a key-on or key-off signal. The keyboard 1 is functionally divided into a right region 1R and a left region 1L. During the course of other than the automatic accompaniment performance, both of the right and left regions 1R, 1L are normally operated to instantly generate corresponding tones. On the other hand, during the course of the automatic accompaniment performance, the right region 1R is normally operated as usual to generate instantly corresponding tones, while the left region is assigned for input and detection of chords without instant generation of tones.

Figures 2, 3:
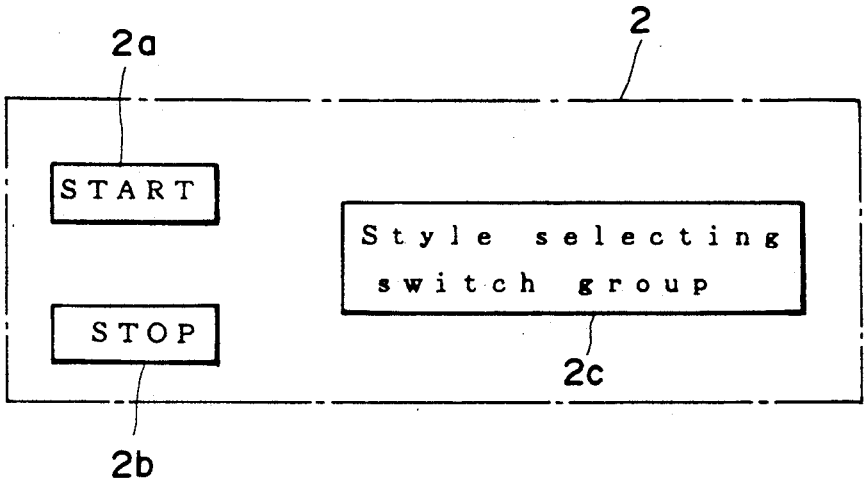
FIG. 2 is a schematic view of a panel switch unit associated with the automatic accompaniment device.
FIG. 3 is a table diagram showing an example of a prescribed accompaniment pattern used in the inventive device.

Referring to FIG. 2, the panel switch unit 2 is comprised of various switches including a start switch 2*a* for initiating an automatic accompaniment, a stop switch 2*b* for stopping the automatic accompaniment, a group of style selecting switches 2*c* for selecting a desired accompaniment pattern matching with a style of the music composition to be played. When a switching operation is effected on the panel switch unit 2, a switch event detecting circuit 4 (shown in FIG. 1) detects that switching operation to produce a signal corresponding to the operated switch.

Referring back to FIG. 1, a CPU 5 is provided to control the electronic musical instrument. The CPU 5 is connected through a bidirectional bus line 6 to those of the key event detecting circuit 3 and the switch event detecting circuit 4 as well as to a table data memory 7, a working memory 8, a program memory 9 and a sound source circuit 10. The table data memory 7 and program memory 9 are composed of a ROM, and the working memory 8 is composed of a RAM.

The sound source circuit 10 is provided with a normal tone generator (TG) for generating a normal musical tone signal in response to a key depression, an accompaniment tone generator (TG) for generating chord and base tones during the course of the automatic accompaniment performance, and a rhythm tone generator (TG) for generating rhythm tones during the course of the automatic accompaniment performance. The sound source circuit 10 operates according to those of the key-on/key-off signal, tone color data and tone pitch code (key code) etc. fed from the CPU 5 so as to form a musical sound signal. A sound system 11 comprised of an amplifier and a speaker etc. is inputted with the musical sound signal to generate a musical sound accordingly.

A tempo clock circuit 12 is also connected to the CPU 5 for generating a tempo clock signal at timings determined by a given constant tempo designated by the CPU 5. In return, the CPU 5 operates in response to the tempo clock signal from the tempo clock circuit 12 to execute interrupting process so as to sequentially generate tones during the automatic accompaniment performance. In this embodiment, resolution of tone generation is set to an eighth note unit so that the tempo clock circuit 12 produces a tempo clock signal effective to time each of the sequence of eighth notes according to a tempo of a given music composition.

The table data memory 7 is stored with accompaniment patterns, chord patterns and a chord conversion table. As shown in FIG. 3, one set of the accompaniment pattern is comprised of six tracks named CHORD1, CHORD2 and CHORD3 each representative of a different tone color or a different kind of musical instrument, BASS representative of bass tones, and RHYTHM1 and RHYTHM2 each representative of a different rhythm tone color. Each track TR has a length of two measures, and therefore is divided into 16 number of sections corresponding to 16 number of tempo clocks CLK. Each section stores a prescribed code such as a note code of C major scale.

The FIG. 3 table shows one example of accompaniment pattern, in which each code datum is suffixed by H and represented in terms of hexadecimal notation. Code data $O_H$ through $E_H$ represent key codes indicative of tone pitches within on octave in those of tracks CHORD1, CHORD2, CHORD3 and BASS. The same hexadecimal codes represent rhythm tone colors in those of tracks RHYTHM1 and RHYTHM2. Further, the remaining code $F_H$ indicates a nontransient state where tone generation is not initiated, nor is terminated. These codes are sequentially addressed or read out according to a track number TR assigned to each track and by a pointer composed of each tempo clock value CLK which takes 0 through 15 shifted cyclicly by mod-16 each interrupting operation timed by the tempo clock signal during the course of the automatic accompaniment performance. Plural sets of accompaniment patterns are provisionally memorized corresponding to different styles of music compositions. A suitable accompaniment pattern can be selected in reproducing of the automatic accompaniment according to a style number STL designated by one of the style selecting switches 2*c*.

As mentioned above, each accompaniment pattern is recorded in terms of note codes in C major scale. On the other hand, as shown in FIG. 4, various chord patterns are recorded each in terms of 12-bit data CHDPT(i) representative of a set of 12 note names C, C#, ---, B for each of different types of chords, where i denotes a certain chord type code CTP. Each type of the chords (M, m, 7th, m7th, 7th sus4, ---) is comprised of constituent notes which are indicated by bit 1 in each set of 12 bit data. Nonconstituent notes are indicated by bit 0 in the same set. Each set of 12-bit data CHDPT(i) is retrieved by an address or table number in the form of the chord type code CTP. Further, the FIG. 4 chord pattern table is constructed with using root note C of C major chord as the standard basis. The 12-bit data retrieved from the FIG. 4 table according to the type of chord is then cyclicly bit-shifted as indicated by the arrow according to a root note code of a detected chord, so that the original 12-bit data is converted to form a chord pattern of the detected chord. Namely, the root code note of the detected chord indicates bit-shift number of the original 12-bit data.

FIG. 5 shows an example of chord conversion table. This table contains data utilized for converting key codes read out from the accompaniment pattern according to the type of the detected chord.

In this embodiment, the tonality is detected or judged when a dominant 7th chord (7th chord) or dominant 7th suspended 4 chord (7sus4 chord) is detected. Further, the tonality judgment is effected on the basis of a major chord (Maj chord), major 7th chord (Maj 7 chord), minor chord (min chord) or minor 7th chord (min 7th chord), those of which have been detected before the detection of 7th chord or 7sus4 chord. The 7th chord or 7sus4 chord is frequently used as a dominant chord relative to a tonic chord of the given music composition. The tonality judgment is based on the fact that when the tonality is of minor scale the 3rd, 9th and 13th note names in the dominant chord do not coincide with note names of that minor scale, and that when the tonality is of major scale the 3rd, 9th, and 13th note names in the dominant chord coincide with note names of that major scale.

Figure 14:
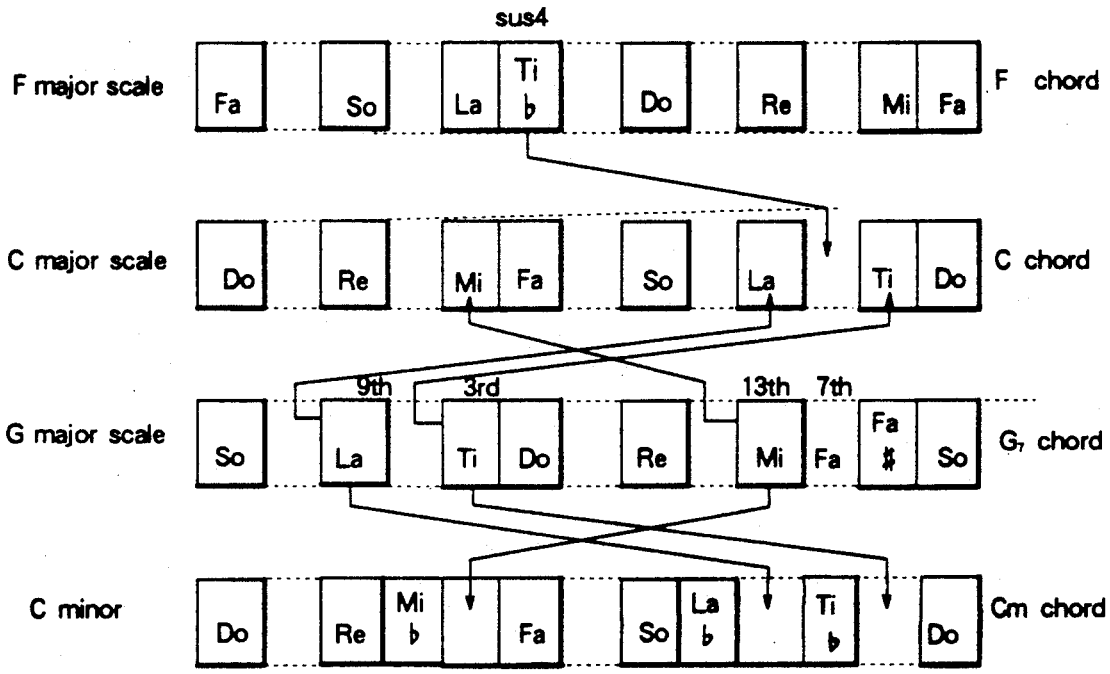
FIG. 14 is an illustrative diagram showing examples of musical scales in different tonalities, associated with the inventive device.

For example, as shown in FIG. 14, there exist in G major scale 3rd note Ti, 9th note La and 13th note Mi with respect to the root note So of $G_7$ chord. Among major scales in different tonalities, $G_7$ chord is utilized as a dominant chord in the C major scale. Among minor scales in different tonalities, $G_7$ chord is utilized as a dominant chord in the C minor scale. The 3rd, 9th and 13th notes of $G_7$ chord are all included in the C major scale, while these 3rd, 9th and 13th notes are all precluded from the C minor scale.

Based on the above described judgment or detection of the tonality, tone pitches of chord to be generated are suitably adjusted or changed in the following five cases:

Case 1. In case that tonality is of major key, sus4 note of Maj chord and Maj7 chord is lowered by a semitone pitch provided that the Maj chord and the Maj7 chord have a root note which is lower by 2 degrees (two semitones) than that of the detected 7th chord or 7sus4 chord.

Case 2. In case that the detected tonality is of major key, b6 (#5) note of min chord and min7 chord is lowered by one semitone pitch provided that the min chord and min7 chord have a root note which is lower by 4 degrees (five semitones) than that of the detected 7th chord or 7sus4 chord.

Case 3. In case that the discriminated tonality is of minor key, b6 (#5) note of min chord or min7 chord is lowered by one semitone pitch provided that the min chord and the min7 chord have a root note which is lower by 5 degrees (seven semitones) than that of the detected 7th chord or 7sus7 chord.

Case 4. In case that the discriminated tonality is of minor key, sus4 note of Maj chord or Maj7 chord is lowered by one semitone interval provided that the Maj chord and the Maj7 chord have a root note which is lower by 3 degrees (four semitones) than that of the detected 7th chord or 7sus4 chord.

Case 5. In case that the tonality is of minor key, 9th note and 13th note of 7th chord and 7sus4 chord are changed, respectively, to b9th note and b13th note.

The program memory 9 stores control programs indicated by flow charts shown in FIGS. 6–13. The CPU 5 operates based on the control programs to control the electronic musical instrument including the inventive automatic accompaniment device, with using various registers provided in the working memory 8. It should be noted here that, in the following description and the flow charts shown in FIGS. 6–13, registers of the working memory 8 are denoted by labels listed below and the respective registers and their contents are both indicated by the same label names unless otherwise noted.

RUN: Run flag indicative of whether the automatic accompaniment is running (="1") or is suspended (="0")

Figure 6:
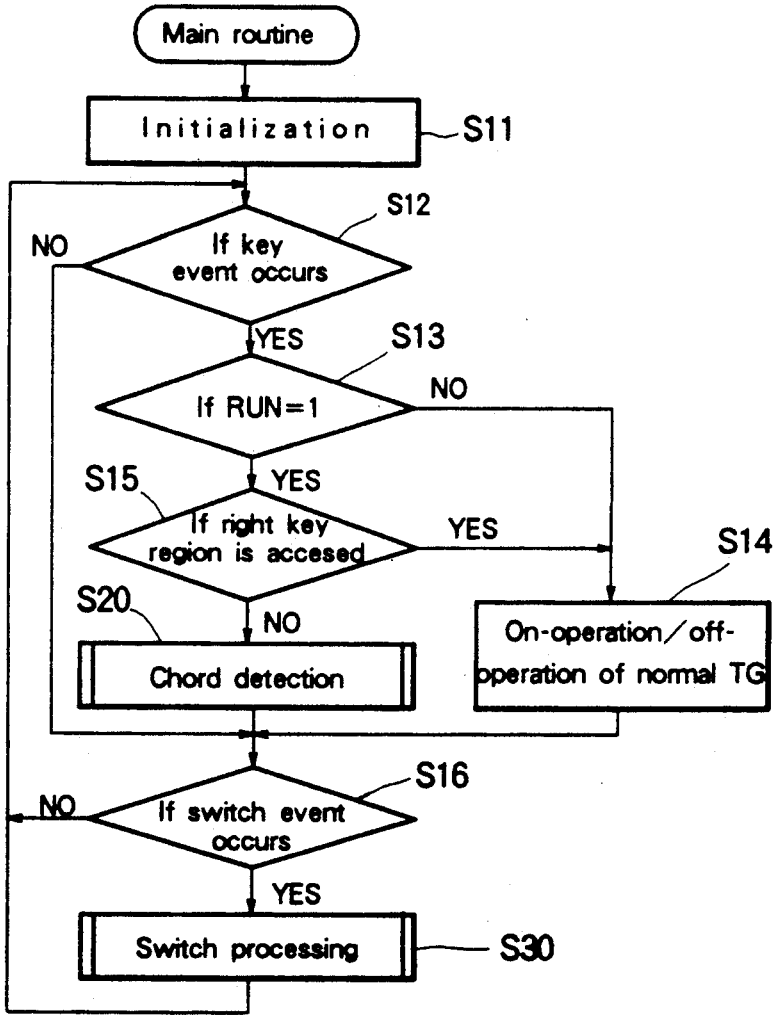
FIG. 6 is a flow chart showing a main routine executed in the inventive device.

CLK: Count values of tempo clocks, which is incremented step by step each eighth note occurrence STL: Selected style number indicative of a style of a given music composition NBP1: 12-bit data representative of a stocked chord pattern NBP2: 12-bit data representative of detected 7th chord pattern or 7sus4 chord pattern CRT: Note code of the root note of a detected chord CTP: Type code of a detected chord ROOT: Note code of the root note of detected 7th chord and 7sus4 chord TYPE: 12-bit data indicative of the result of tonality detection in the form of major key =0 and minor key =1 or more 3RD: Note code of 3rd tone with respect to the root note of detected 7th and 7sus4 chord 9TH: Note code of 9th tone with respect to the root note of detected 7th and 7sus4 chord 13TH: Note code of 13th tone with respect to the root note of detected 7th and 7sus4 chord 4TH: Note code of 4th note with respect to a certain note which is lower, by 2 or 3 degrees, than the root note of the detected 7th and 7sus4 chord b6TH: Note code of b6th note with respect to a certain note which is lower, by 4 or 5 degrees, than the root note of the immediately precedingly detected 7th chord ONF (STL): Flag settable in function of the music style number STL and indicative of whether tone pitch adjustment is effected or inhibited KC: Key code obtained by conversion using the chord conversion table NT: Note code corresponding to the key code KC converted with using the chord conversion table TR: Track number in the selected accompaniment pattern FIG. 6 illustrates a main routine of the control programs, and FIGS. 7–13 show various subroutines and clocked interrupting process routine. The clocked interrupting process routine is executed at timings of each eighth note occurrence in response to the clock signal from the tempo clock circuit 12 even during the course of processings of the main routine and subroutines.

When a power supply is turned on in the instant electronic musical instrument, the CPU 5 starts processing of the FIG. 6 main routine. At first, in step S11, the initial state is set up such that various parameters are initialized and respective registers are cleared. Then, in step S12, check is made as to whether a key event occurs or not according to a key-on/key-off signal and a key code KCD provided from the key event detecting circuit 3. The processing is jumped to step S16 if no key event occurs.

On the other hand, if any key event occurs, subsequent check is made in step S13 as to if RUN is set to "1" or not. If RUN ≠"1" is held, processing advances to step S14 where the normal tone generator (TG) is actuated to carry out on-operation or off-operation, thereafter proceeding to step S16.

If RUN ="1" is held in step S13, processing advances to step S15 where check is made as to if the key event has occurred in the right region 1R of the keyboard. If the key event has occurred in the right region 1R, processing goes to step S14 and subsequent steps. On the other hand, if the key event has occurred in the left region 1L, chord detecting process is carried out in step S20 (the detail of which will be described later in conjunction with the FIG. 8 flow chart), thereafter proceeding to step S16.

In step S16, check is made as to if a switch event occurs or not based on an output signal from the switch event detecting circuit 3. If switch event occurs, a corresponding switch processing is executed in step S30. The detail of switch processing will be described later in conjunction with the FIG. 7 flow chart. If there is no switch event, the main routine returns to step S12 to repeatedly execute the same processing.

Figure 7:
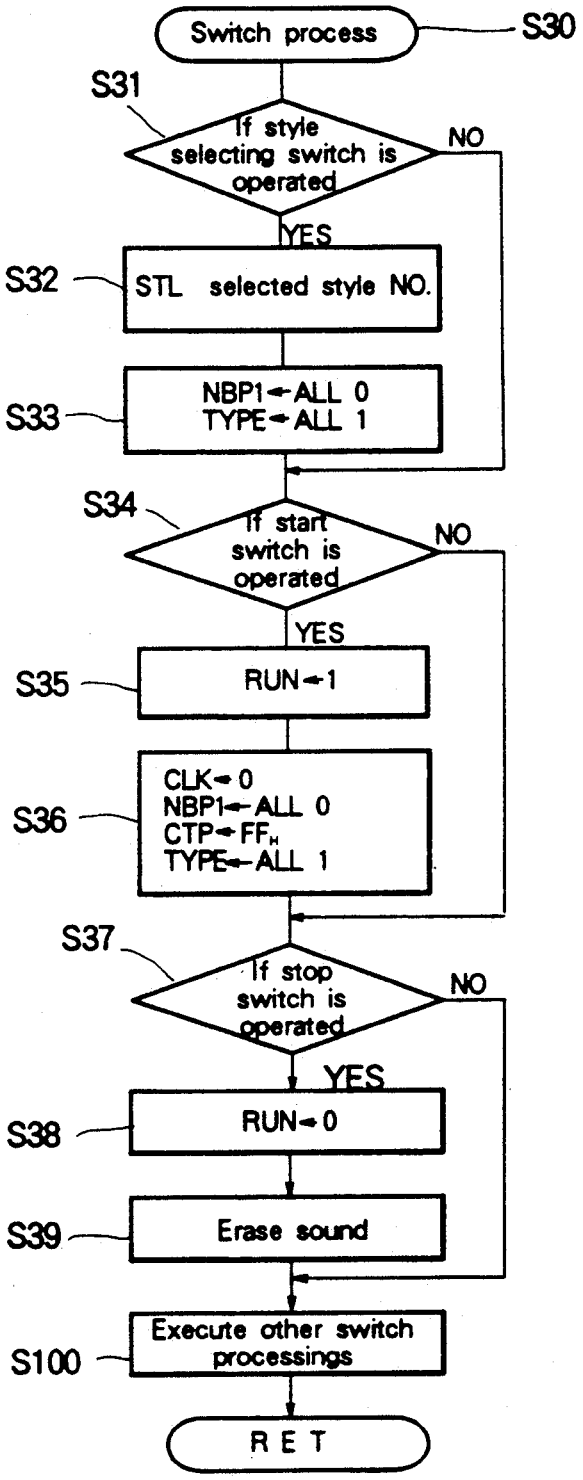
FIG. 7 is a flow chart showing a switch process in the inventive device.

Next, referring to FIG. 7 which shows detail of step S30 of the switch processing, firstly in step S31, check is made as to whether a style selecting switch 2c has been operated or not. If the check is held no operation, processing is jumped to step S34. On the other hand, if the style selecting switch has been operated, STL is loaded with a style number corresponding to the selected style of music in step S32. Then in step S33, 12 bits of NBP1 are all reset to "0" as well as 12 bits of TYPE are all set to "1". Thereafter, the processing advances to step S34.

Next check is made as to whether the start switch 2a is operated or not in step S34. If not, the processing is jumped to step S37. On the other hand, if the start switch 2a has been operated, RUN is set to "1" in step S35. Then, in step S36, CLK and NBP1 are reset to "0", CTP is set to "$FF_H$", and 12 bits of TYPE are again all assured to "1". Thereafter, processing advances to step S37.

Further check is made as to whether the stop switch 2b is operated or not in step S37. If not, processing is jumped to step S100 in which other switch processings are executed, and thereafter the processing returns to the main routine. On the other hand, if it is held that the stop switch 2b has been operated, RUN is reset to "0" in step S38, and then sound erase process is effected in step S39. Thereafter, the processing returns to the main routine after carrying out the process of step S100. In the above routine, processing of step S39 may be skipped when decaying tones are generated in the instrument. As described above, the selected style number is written into STL. Further, RUN flag is set to "1" at the start of automatic accompaniment, and is reset to "0" at the stop of automatic accompaniment.

Figure 8:
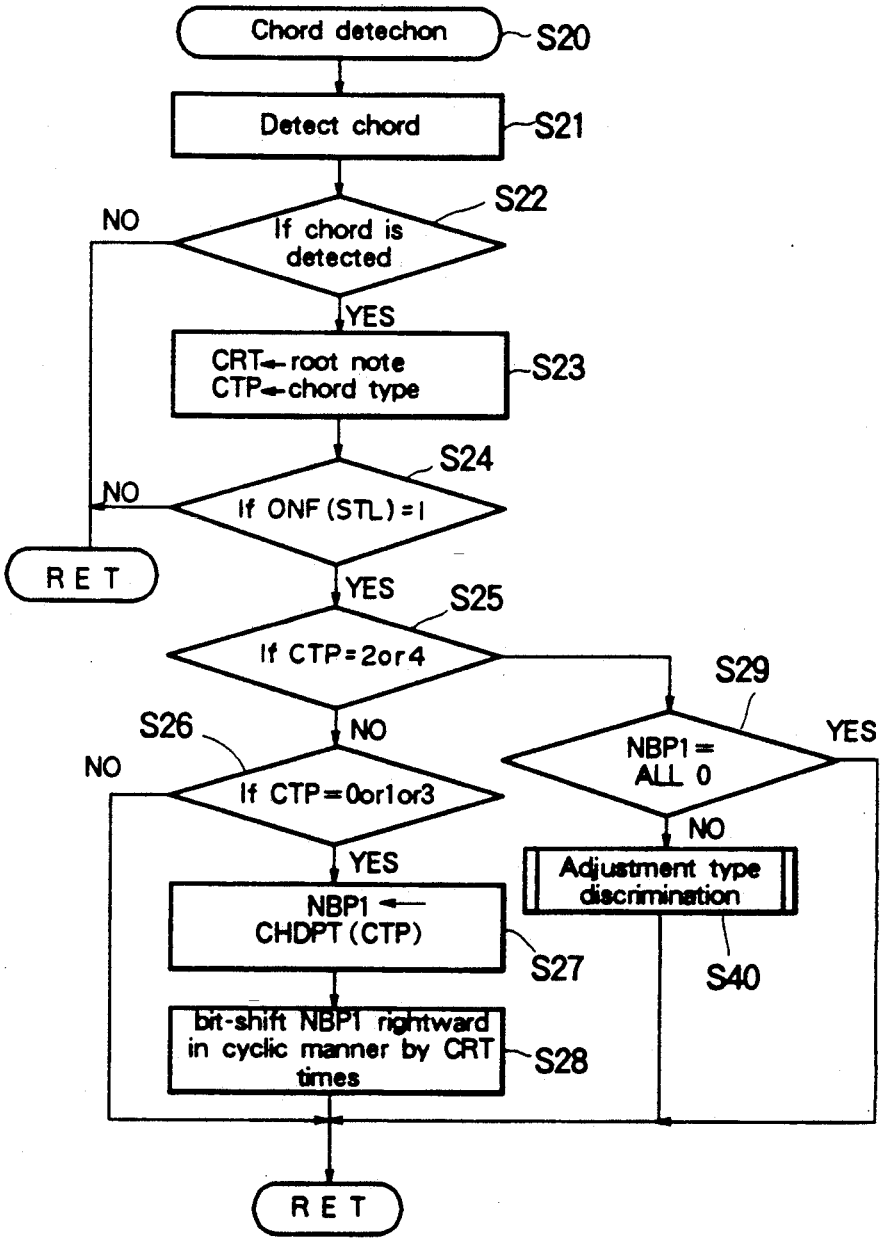
FIG. 8 is a flow chart illustrating a chord detecting process in the inventive device.

Referring to FIG. 8 which shows detail of the step S20 of the chord detecting process, firstly in step S21 the chord detection is carried out based on key codes inputted from the left region of the keyboard. Then in step S22, check is made as to whether a chord has been actually detected or not. If not, processing returns. On the other hand, if the judgment is held that a chord has been detected, CRT is set with a note code of the root of the detected chord, i.e., bit-shift number of the chord pattern shown in FIG. 3, and CTP is set with a type code of the detected chord in step S23. Further in step S24, check is made as to whether ONF (STL) is set with "1" or not.

If ONF (STL) is set with "0" so that the presently selected style of the music does not need adjustment of tone pitches, the processing returns so that the adjustment is inhibited. On the other hand, if ONF (STL) is set with "1" so that the presently selected style needs adjustment of tone pitches, subsequent judgment is made as to whether CTP indicative of the type of the detected chord is set with either of "2" and "4" in step S25. Namely, the step S25 is carried out so as to discriminate whether the detected chord is either of 7th chord and 7sus4 chord, or other types of chords (see FIG. 4 table).

When it is held that CTP is not set with either of "2" or "4" in step S25, subsequent judgment is carried out in step S26 as to whether CTP is set with "0" indicative of Maj chord, "1" indicative of min chord, or "3" indicative of m7th chord. If CTP is set with none of "0", "1" and "3", the process returns to the main routine. On the other hand, if CTP is set with one of "0", "1" or "3", stock NBP1 is loaded with 12-bit data CHDPT (CTP) of a particular chord pattern addressed by the type code CTP in step S27. Then in step S28, the 12-bit data loaded or stocked in NBPl is rightwardly bit-shifted in cyclic manner given times determined by the value of CRT so that the 12-bit data is converted to represent a chord pattern of the detected chord in the register NBP1. Then, the processing returns.

When it is held that CTP indicates either of "2" and "4" in step S25, the processing advances to step S29 in which check is made as to whether all bits of NBPl are set with "0". If all bits are set with "0", it is judged that there was not detected previously any of Maj chord, min chord and m7th chord, thereby returning to the main routine. On the other hand, if at least one of 12 bits of NBP1 is set with "1", the processing proceeds to step S40 where is carried out adjustment type discrimination process, detail of which will be described hereinbelow in conjunction with FIG. 9. Lastly, the processing returns to the main routine.

Figure 9:
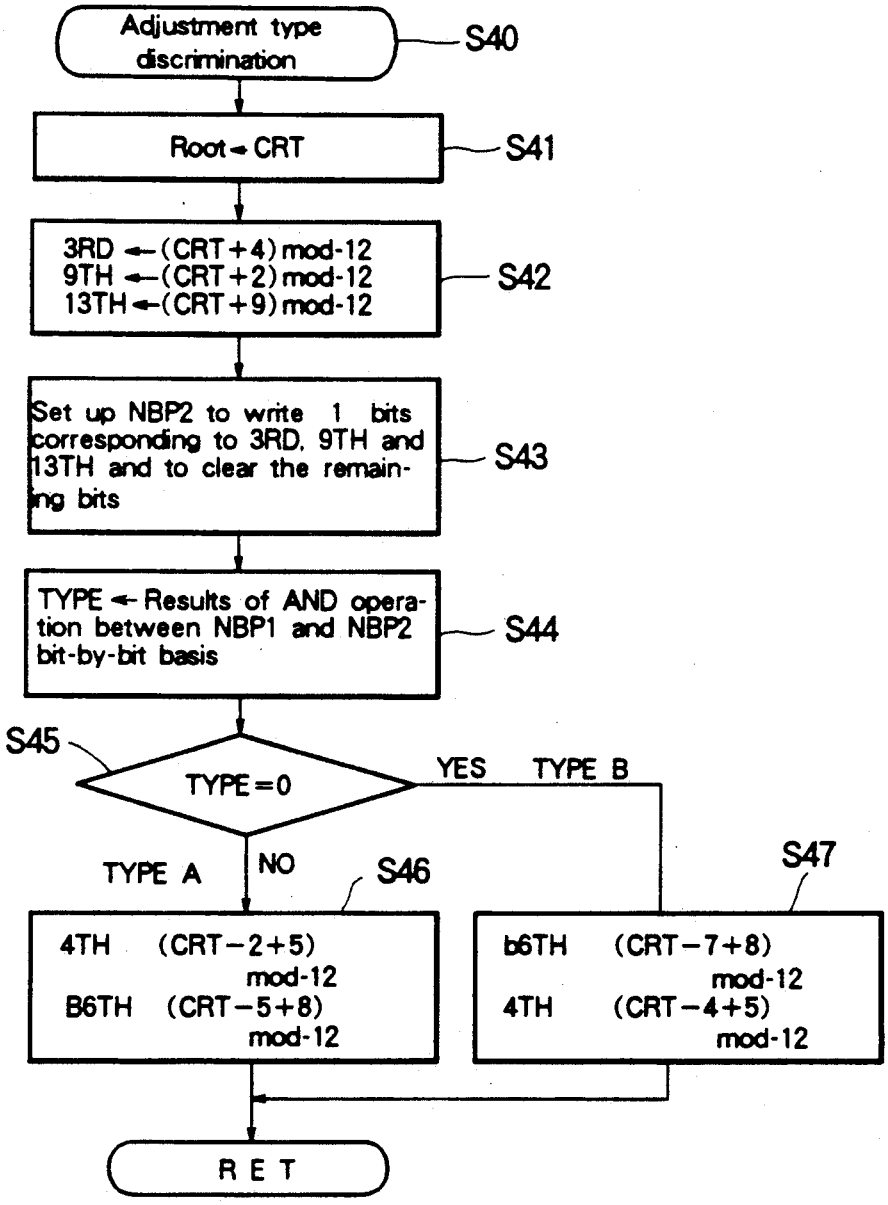
FIG. 9 is a flow chart illustrating a process for discriminating adjustment type in the inventive device.

Referring to FIG. 9 which shows the adjustment type discrimination process S40, firstly the root note code CRT of the detected chord (either of 7th chord or 7sus4 chord) is reserved to ROOT. Then, in step S42, 3RD is loaded with (CRT+4) of mod-12, 9TH is loaded with (CRT+2) of mod-12, and 13TH is loaded with (CRT+9) of mod-12. By such processing in step S42, there can be obtained the note codes of 3rd tone, 9th tone and 13th tone of the detected 7th chord or 7sus4 chord.

In the subsequent step S43 after executing the process of step S42, NBP2 is loaded with the thus obtained note codes of 3rd, 9th and 13th such that corresponding bits are set to "1" and the remaining bits are reset to "0" in the 12-bit data formation of NBP2. Then in step S44, logical product operation or AND operation is carried out bit-by-bit basis between 12-bit data of NBPl and the other 12-bit data of NBP2. The results of this AND operation is stored in TYPE. In this processing, the register NBPl stores, in the form of bits "1", constituent notes of Maj chord, min chord or m7th chord which was precedingly detected before the current detection of 7th chord or 7sus4 chord. By the above noted processing in step S44, as described before in conjunction with the example of FIG. 14, the detection is made as to whether the tonality is of major key or minor key according to coincidence of 3rd, 9th or 13th tone of the 7th chord or 7sus4 chord with constituent notes of the previously detected chord. Namely, there is a bit-coincidence in case of major key so that 12-bit data of TYPE contains at least one bit "1". Hereinafter, this situation is called Type A. On the other hand, there is no bit-coincidence in case of minor key so that all bits of TYPE are loaded with "0". Hereinafter, such situation is called Type B.

Next in step S45, check is made as to whether TYPE is set with "0" or not. If the check is held negative, processing proceeds to step S46 for the Type A course. On the other hand, if the check is held affirmative, processing proceeds to step S47 for the Type B course. Lastly, the processing returns. In step S46, the register 4TH is loaded with (CRT-2+5) of mod-12 and the other register b6TH is loaded with (CRT-5+8) of mod-12, thereby determining codes of sus4 note and b6 note which are an object of the adjustment processing in the before-mentioned Case 1 and Case 2. In similar manner, in step S47, the register b6TH is loaded with (CRT-7+8) of mod-12 and the other register 4TH is loaded with (CRT-4+5) of mod-12, thereby determining codes of b6 note and sus4 note which are an object of the adjustment processing in the before-mentioned Case 3 and Case 4.

Figure 10:
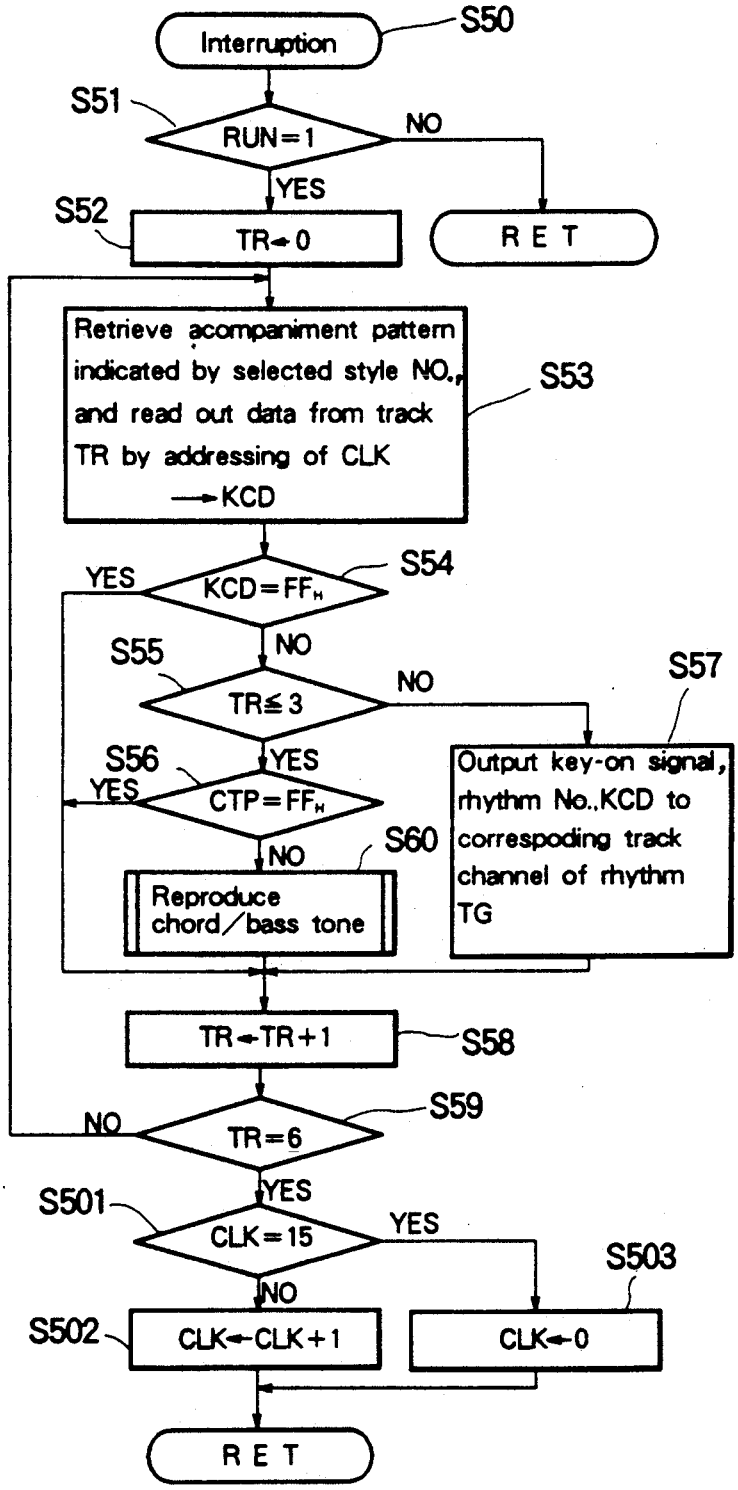
FIG. 10 is a flow chart illustrating a clocked interruption process in the inventive device.

As described above, after the power source is turned on, the main routine and various subroutines are executed, while the interrupting process routine of FIG. 10 is called at each occurrence of eighth note. During the course of interrupting process S50, firstly in step S51, the flag RUN is checked so that the interrupting process is immediately returned if RUN #"1" is held. On the other hand, if RUN ="1" is held, the track number TR which denotes each track of the accompaniment pattern is reset to "0" to then proceed to subsequent step S53.

In step S53, one accompaniment pattern is retrieved in correspondence with the selected style number STL. Then, data is retrieved from the track TR with using the clock value CLK as an addressing signal, and the retrieved data is loaded in KCD. Then in step S54, a check is made as to whether KCD is set with "$FF_H$". If KCD "$FF_H$" is held, the processing is jumped to step S58. On the other hand, if KCD $\neq$"$FF_H$" is held, the processing advances to step S55 where check is made as to if TR is equal to or less than "3".

Next, if TR $\leqq$3 is not held in step S55, it is assumed that a track of RHYTHM1 or RHYTHM2 is on processing. Thus, in step S57, the data is outputted to the rhythm tone generator (TG) so as to generate rhythm tones. Then, processing proceeds to step S58. On the other hand, if TR $\leqq$"3" is held, subsequent check is made in step S56 as to whether CTP is set with "$FF_H$". Then, if CTP ="$FF_H$" is held, the processing is jumped to step S58. On the other hand, if CTP $\neq$"$FF_H$" is held, subsequent step S60 is executed to carry out chord, bass tone reproduction process, detail of which will be described hereinbelow in conjunction with FIG. 11. Then the processing advances to step S58. Consequently, tone generation is not effected when a chord is not detected. On the other hand, the tone generation is effected in step S60 when a chord was detected.

In subsequent step S58, TR is incremented to TR+1. Then, check is made in step S59 as to if TR reaches "6". If TR does not reach "6", step S53 and following steps are repeatedly executed to effect similar processing for each track of the accompaniment pattern. On the other hand, if it is held that TR reaches "6", subsequent check is made in step S501 as to if the clock value CLK reaches "15". If CLK $\neq$"15" is held, CLK is incremented to CLK+1 in step S502. On the other hand, if CLK ="15" is held, CLK is returned to "0" in step S503. In this manner, the interrupting process is repeatedly carried out sixteen times for two measures. The accompaniment pattern of the two measures is repeatedly reproduced to perform continuous automatic accompaniment.

Figure 11:
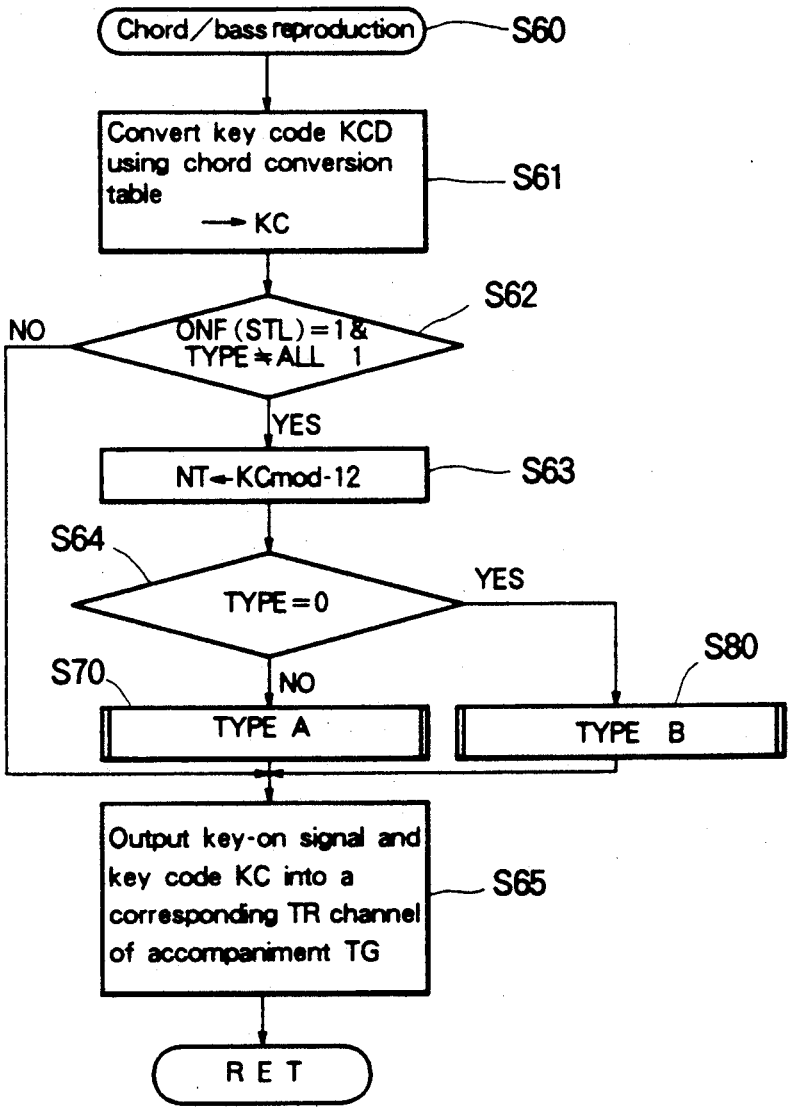
FIG. 11 is a flow chart illustrating a process for reproducing chord and bass tones in the inventive device.

Referring to FIG. 11 which shows detail of the chord/bass reproduction process S60, firstly in step S61, the key code KCD is converted using the chord conversion table of FIG. 5 such that the converted KCD is set to KC. Then in step S62, a check is made as to whether is satisfied the following condition that ONF (STL) is set to "1" and all bits of TYPE are not "1". If this condition is not satisfied, the processing is jumped to step S65. On the other hand, if this condition is satisfied, KC is converted into a corresponding note code representation which is set in NT in step S63. Further in step S64, check is made as to whether TYPE is set with "0" or not. If TYPE $\neq$"0" is held, the processing advances to step S70 so as to execute process of Type A, detail of which will be described later in conjunction with FIG. 12. On the other hand, if TYPE ="0" is held, the processing advances to step S80 so as to execute process of Type B, detail of which will be described later in conjunction with FIG. 13. The Type A process is carried out to deal with the before-mentioned Case 1 and 2 in step S70, while the Type B process is executed to deal with the before-mentioned Case 3, Case 4 and Case 5 in step S80, in order to adjust key codes. Thereafter in step S65, the key code KC which might be adjusted or not is outputted to the accompaniment tone generator (TG) together with a key-on signal so as to effect sound generation.

Figure 12:
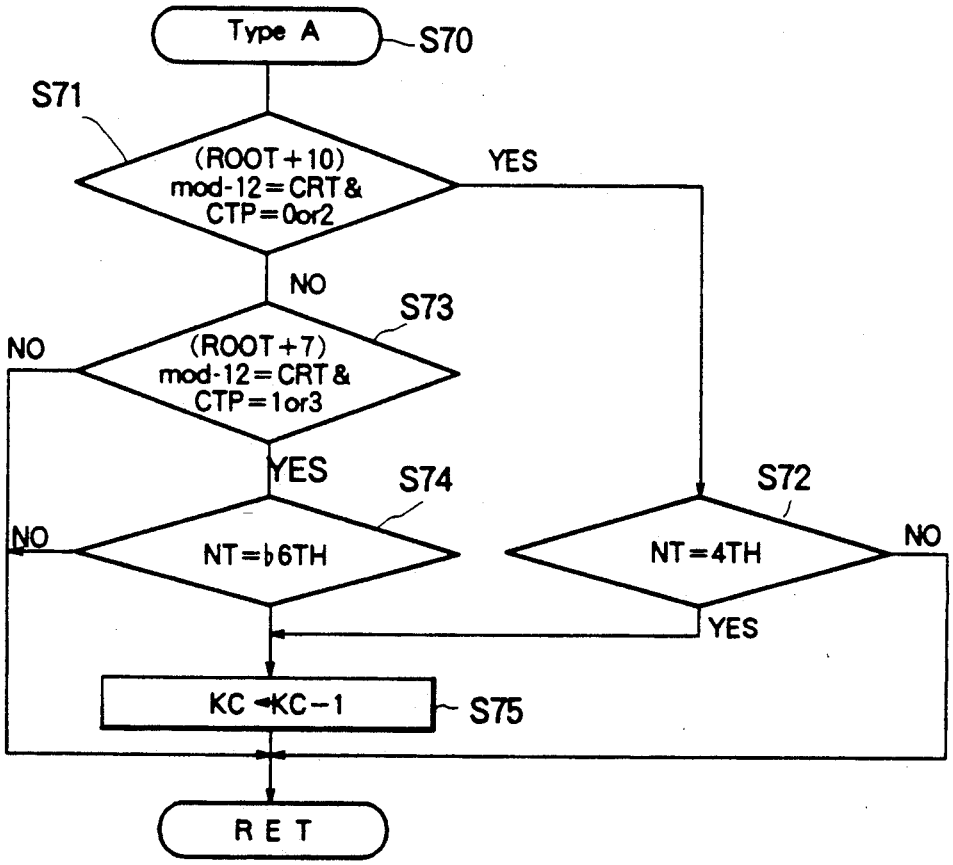
FIG. 12 is a flow chart showing an adjustment process of Type A in the inventive device.

Referring to FIG. 12 which shows the Type A process, step S71 and step S72 are adjustment processing associated with Case 1. In this processing, there is utilized the register ROOT which reserves the root note code of the detected 7th chord or 7sus4 chord. Therefore, (ROOT+10) of mod-12 notation represents a reference note code lower than the root note of the detected 7th chord or 7sus4 chord by 2 degrees (two semitones). Thus, in step S71, discrimination is made as to whether the present root note set in CRT coincides with the reference note code which is 2 degrees (two semitones) below the root note of 7th chord or 7sus4 chord and whether the chord type set in CTP indicates either of Maj chord and Maj7 chord. If it is held that the root note CRT equals to that reference note code and the chord type CTP indicates either of Maj chord and Maj7 chord, subsequent discrimination is made in step S72 as to whether the note code NT to be sounded corresponds to sus4 tone of the Maj chord or Maj7 chord. If the check confirms the sus4 tone, the key code KC is decremented by 1 degree to lower one semitone so as to effect adjustment.

Step S73 and step S74 are adjustment processing associated to Case 2. Discrimination is made in step S73 as to whether the present root note code set in CRT is identical with a reference note code which is lower than the root note of the 7th chord or 7sus4 chord by 4 degrees (five semitones) and whether the chord type code set in CTP indicates either of min chord and min7 chord. If it is held that the root note CRT equals to the reference note code and the chord type CTP indicates either of min chord and min7chord, the subsequent discrimination is made in step S74 as to whether the note code NT to be generated corresponds to b6 tone. If the judgment proves b6 tone, key code KC is decremented by one unit to lower a semitone pitch.

Figure 13:
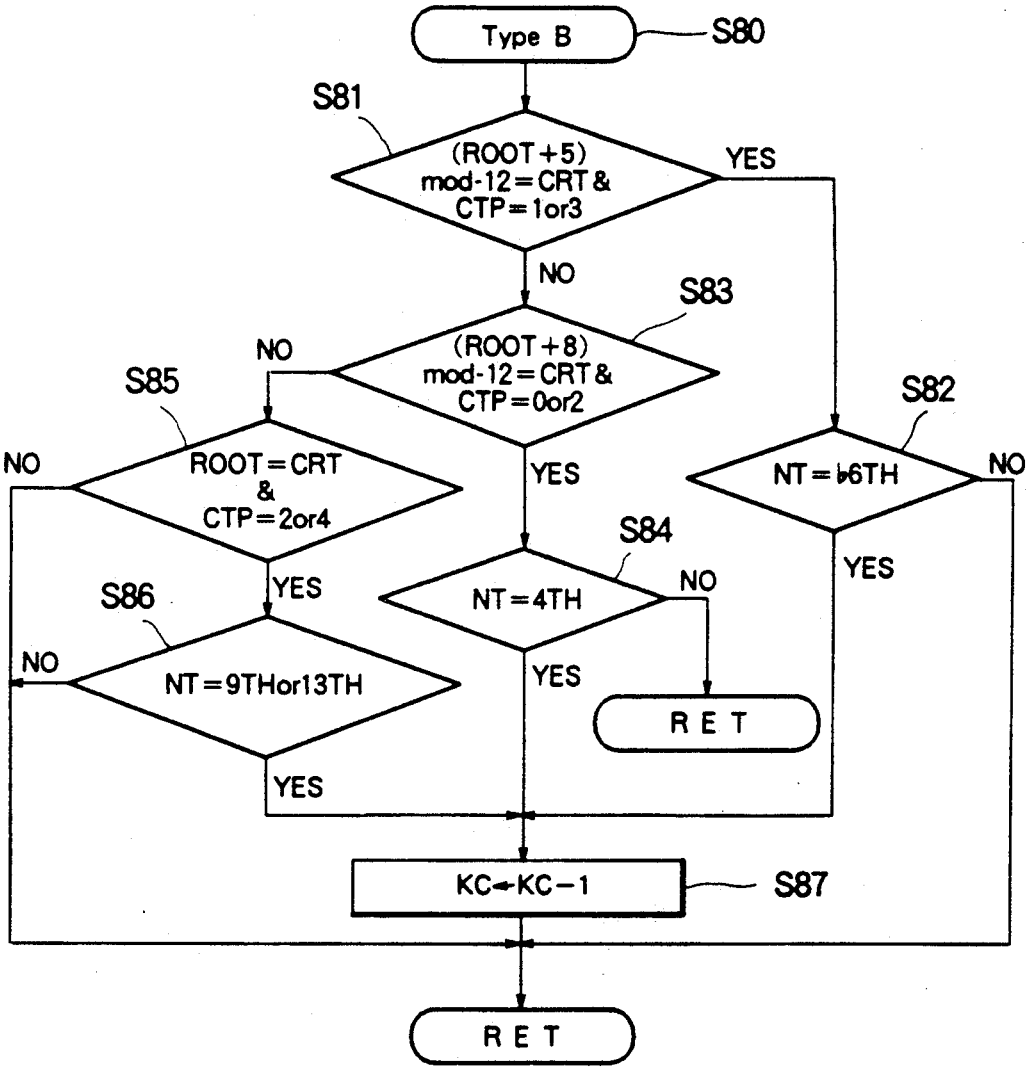
FIG. 13 is a flow chart showing an adjustment process of Type B in the inventive device.

Referring to FIG. 13 which shows the Type B process, step S81 and step S82 are adjustment processing associated to Case 3. Namely, first discrimination is made in step S81 as to whether the present root note code set in CRT coincides with a reference note code which is lower than the root note code of 7th chord or 7sus4 chord by 5 degrees (seven semitones) and whether the chord type code set in CRT indicates either of min chord and min7 chord. If it is held that the root note CRT equals to the reference note code and that the chord type CTP designates min chord or min7 chord, second discrimination is made in step S82 as to whether the note code NT to be generated corresponds to b6 tone of min chord or min7 chord. If the judgment proves b6 tone, key code KC is decremented in step S87 by one unit to lower one semitone pitch to thereby effect adjustment in Case 3.

Further, step S83 and step S84 are adjustment processing associated with Case 4. First discrimination is made in step S83 as to whether the present root note code set in CRT coincides with a reference note code which is set lower than the root note of 7th chord or 7sus4 chord by 3 degree (four semitones) and whether the chord type code set in CTP indicates either of Maj chord or Maj7 chord. If it is held that the root note CRT equals to the reference note code and that the chord type code CTP represents Maj chord or Maj7 chord, subsequent discrimination is made in step S84 as to whether the note code NT to be generated corresponds to sus4 tone of the Maj chord or Maj7 chord. If the judgment proves sus4, key code KC is decremented in step S87 by one step to lower a pitch by one semitone interval to thereby effect adjustment in Case 4.

Step S85 and step S86 are adjustment processing related to Case 5. In step S85, discrimination is made as to whether the present root note code set in CRT is identical with the reference root note code of 7th chord or 7sus4 chord and whether the chord type code set in CTP indicates either of 7th chord and 7sus4 chord. If it is held that the root note code of CRT equals to the reference root note code and the chord type CTP indicates either of 7th chord and 7sus4 chord, subsequent discrimination is made in following step S86 as to whether the note code NT to be generated corresponds to 9th tone or 13th tone of 7th chord or 7sus4 chord. If the judgment proves either of 9th and 13th, key code KC is decremented by one step to lower a semitone interval to thereby effect adjustment in Case 5.

As described above, the key code KC is suitably adjusted or changed in different Cases 1-5 by either of Type A process in step S70 and Type B process in step S80 so that the sound generation is effected according to the adjusted key code in the chord/bass ton reproducing process S60. By such operation, based on chord information received and inputted from the keyboard 1, the tonality is detected as to Major key and minor key so as to adjust an inconsistent or unbecoming tone which might be caused by uniform conversion of chords to thereby perform automatic accompaniment in natural manner.

In the above described embodiment, the adjustment of tone pitch is selectively carried out according to a style of a given music composition. For example, Tib tone of chord F may have conformity in a certain style of music such as Blues and Rock'n'roll if tuned to C major key. In such case, the register ONF (STL) is preferably set to "0" if the style number STL indicates Blues or Rock'n'roll, thereby suspending or inhibiting the adjustment of tone pitch.

In the above described embodiment, the tonality is detected based on interrelation or comparison between 7th chord or 7sus chord and a preceding chord; however, the tonality may be discriminated according to melody. Further, target or object tones of the adjustment are not limited to those mentioned in the instant embodiment, but may include other tones if desired.

As described above, the inventive automatic accompaniment device is constructed basically such as to detect a chord based on inputted tone pitch information to convert tone pitch data of a prescribed accompaniment pattern into those of the detected chord to thereby generate accompaniment tones based on the detected chords according to the prescribed accompaniment pattern. According to the invention, the device is characterized in that tonality of the chordal arrangement is detected based on the inputted tone pitch information so as to determine a tone name to be adjusted according to the detected tonality, and that a tone pitch datum corresponding to the determined tone name is designated among the tone pitch data of the detected chord, obtained by the conversion of the accompaniment pattern, to thereby effect adjustment of the tone pitch represented by the discriminated tone pitch datum to generate accompaniment sound. By such construction, there can be performed the automatic accompaniment in conformity with or becoming to the tonality with natural manner.

What is claimed is:

1. An automatic accompaniment device comprising:

chord detecting means for detecting a chord from inputted note information representing note names;

converting means for converting accompaniment tone data representing notes arranged as a predetermined accompaniment pattern into other accompaniment tone data representing notes corresponding to the detected chord;

tonality detecting means for detecting a tonality of a music composition represented by the inputted note information;

note name determining means for determining a note name which is unbecoming to the detected tonality;

note designating means for designating a note corresponding to the determined note name in a converted accompaniment pattern and changing means for changing the designated note into another note which is becoming to the detected tonality so that the converted accompaniment pattern can be becoming to the detected tonality.

2. An automatic accompaniment device according to claim 1 further comprising:

music style designating means for designating a music style from among plural music styles; and selecting means for selecting an accompaniment pattern from among plural accompaniment patterns in accordance with the designated music style, the predetermined accompaniment pattern being one of the plural accompaniment patterns.

3. An automatic accompaniment device according to claim 2 further comprising:

change inhibit means for inhibiting the changing means from changing the designated note when the designated music style is a predetermined one.

4. An automatic accompaniment device operative to detect a chord according to inputted tone pitch information and to convert given tone pitch data arranged in a preset accompaniment pattern into other tone pitch data matched with the detected chord to thereby generate accompaniment tones based on the detected chord according to the preset accompaniment pattern, the device comprising: tonality detecting means operative based on the inputted tone pitch information for detecting a tonality of a given chordal arrangement; determining means operative according to the detected tonality for determining a tone name for adjustment; designating means for designating a certain tone pitch datum corresponding to the determined tone name among the converted tone pitch data; and adjusting means for adjusting a tone pitch represented by the designated tone pitch datum so as to generate accompaniment tones in conformity with the detected tonality.

5. An automatic accompaniment device according to claim 4, including selecting means for selecting a different accompaniment pattern according to a style of a given music composition, and controlling means for controlling the adjusting means to effect adjustment of the tone pitch when the style of the given music composition belongs to a predetermined category.

6. An automatic accompaniment device according to claim 4, wherein the tonality detecting means includes means operative to compare a preceding detected chord with a succeeding detected specific chord for judging the tonality based on a tonal relationship therebetween.

7. A method for automatic accompaniment comprising the steps of:

detecting a chord from inputted note information representing note names;

converting accompaniment tone data, representing notes arranged as a predetermined accompaniment pattern, into other accompaniment tone data, representing notes corresponding to the detected chord;

detecting a tonality of a music composition represented by the inputted note information;

determining a note name which is unbecoming to the detected tonality;

designating a note corresponding to the determined note name in a converted accompaniment pattern; and changing the designated note into another note which is becoming to the detected tonality so that the converted accompaniment pattern can be becoming to the detected tonality.

* * * * *